US006598775B1

(12) United States Patent
Chen

(10) Patent No.: US 6,598,775 B1
(45) Date of Patent: Jul. 29, 2003

(54) HAMMER HEAD ASSEMBLY FOR POWER HAMMER

(75) Inventor: Tung-Hsien Chen, 2/F-3, No. 73, Chiaohsiao St., Keelung City (TW)

(73) Assignees: Tung-Hsien Chen, Keelung (TW); De Poan Pneumatic Corp., Taipei Hsien (TW)

( * ) Notice: Subject to any disclaimer, the term of this patent is extended or adjusted under 35 U.S.C. 154(b) by 0 days.

(21) Appl. No.: 10/231,121

(22) Filed: Aug. 30, 2002

(51) Int. Cl.[7] ..... B25C 1/04

(52) U.S. Cl. ..... 227/113; 227/119; 227/130; 227/142

(58) Field of Search ..... 227/113, 15, 18, 227/130, 119, 142, 147

(56) References Cited

U.S. PATENT DOCUMENTS 3,438,449 A * 4/1969 Smith ..... 227/130
5,074,453 A * 12/1991 Tachihara et al. ..... 227/130
6,138,888 A * 10/2000 Liao ..... 227/130
6,145,723 A * 11/2000 Gupta ..... 227/113
6,308,879 B1 * 10/2001 Wang ..... 227/119
6,364,192 B1 * 4/2002 Lin ..... 227/113

* cited by examiner

*Primary Examiner*—Scott A. Smith
(74) *Attorney, Agent, or Firm*—Rosenberg, Klein & Lee

(57) ABSTRACT

A hammer head assembly used in a power hammer for driving a nail into objects to be fastened is constructed to include a nail holder axially slidably mounted in a hollow mounting base and forced out of the bottom side of the mounting base by a spring member, a magnet fixedly provided inside the nail holder and adapted to attract a nail in vertical for driving into the workpiece, and a hammering rod axially inserted into the nail holder and controlled to drive a nail out of the nail holder into the workpiece.

5 Claims, 8 Drawing Sheets

HAMMER HEAD ASSEMBLY FOR POWER HAMMER

BACKGROUND OF THE INVENTION

1. Field of the Invention

The present invention relates to a power hammer adapted for to drive nails into objects to be fastened together and, more specifically, to a hammer head assembly for power hammer.

2. Description of the Related Art

FIG. 11 shows a hammer head assembly for power hammer according to the prior art. According to this design, the hammer head assembly comprises a hollow mounting base 8, the mounting base 8 having an outer thread 81 threaded into the corresponding mounting hole of the power hammer and an axially extended stepped center through hole 82, a nail holder 7 axially slidably mounted in the axially extended stepped center through hole 82 of the mounting base 8, the nail holder 7 having a bottom hole 71 adapted to receive a nail 9 having a head 91, a compression spring 811 mounted inside the mounting base 8 and imparting a downward pressure to the nail holder 7, a magnet 72 provided inside the nail holder 7 and adapted to attract the nail 9 loaded in the bottom hole 71 of the nail holder 7, and a hammering rod 73 inserted into the nail holder 7 and adapted to drive the loaded nail 9 into the workpiece. This design of hammer head assembly is practical for driving regular nails into the workpiece, however it is not suitable for driving washer faced screw nails.

SUMMARY OF THE INVENTION

The present invention has been accomplished under the circumstances in view. It is one object of the present invention to provide a hammer head assembly for power hammer, which is suitable for driving any of a variety of nails. It is another object of the present invention to provide a hammer head assembly for power hammer, which positively holds the loaded nail in position for driving. To achieve these and other objects of the present invention, the hammer head assembly comprises an externally threaded mounting base fastened to a mounting hole of the power hammer, the mounting base having an axially extended center through hole extended through top and bottom sides thereof; a nail holder axially slidably inserted into the axially extended center through hole of the mounting base from the bottom side of the mounting base, the nail holder having a longitudinal sliding groove in the periphery thereof, an axially extended center through hole, and a bottom skirt extended around a bottom end of the axially extended center through hole of the nail holder, the bottom skirt having a vertical peripheral wall defining a receiving open chamber adapted to hold the washer of a washer faced screw nail; a spring member provided inside the mounting base and adapted to force the nail holder downwardly out of the mounting base; a hammering rod inserted into the axially extended center through hole of the mounting base and the axially extended center through hole of the nail holder and adapted to drive a nail into the workpiece; and at least one magnet mounted inside the nail holder and adapted to attract a nail for enabling the attracted nail to be driven into the workpiece by the hammering rod.

DETAILED DESCRIPTION OF THE PREFERRED EMBODIMENT

Figure 1:
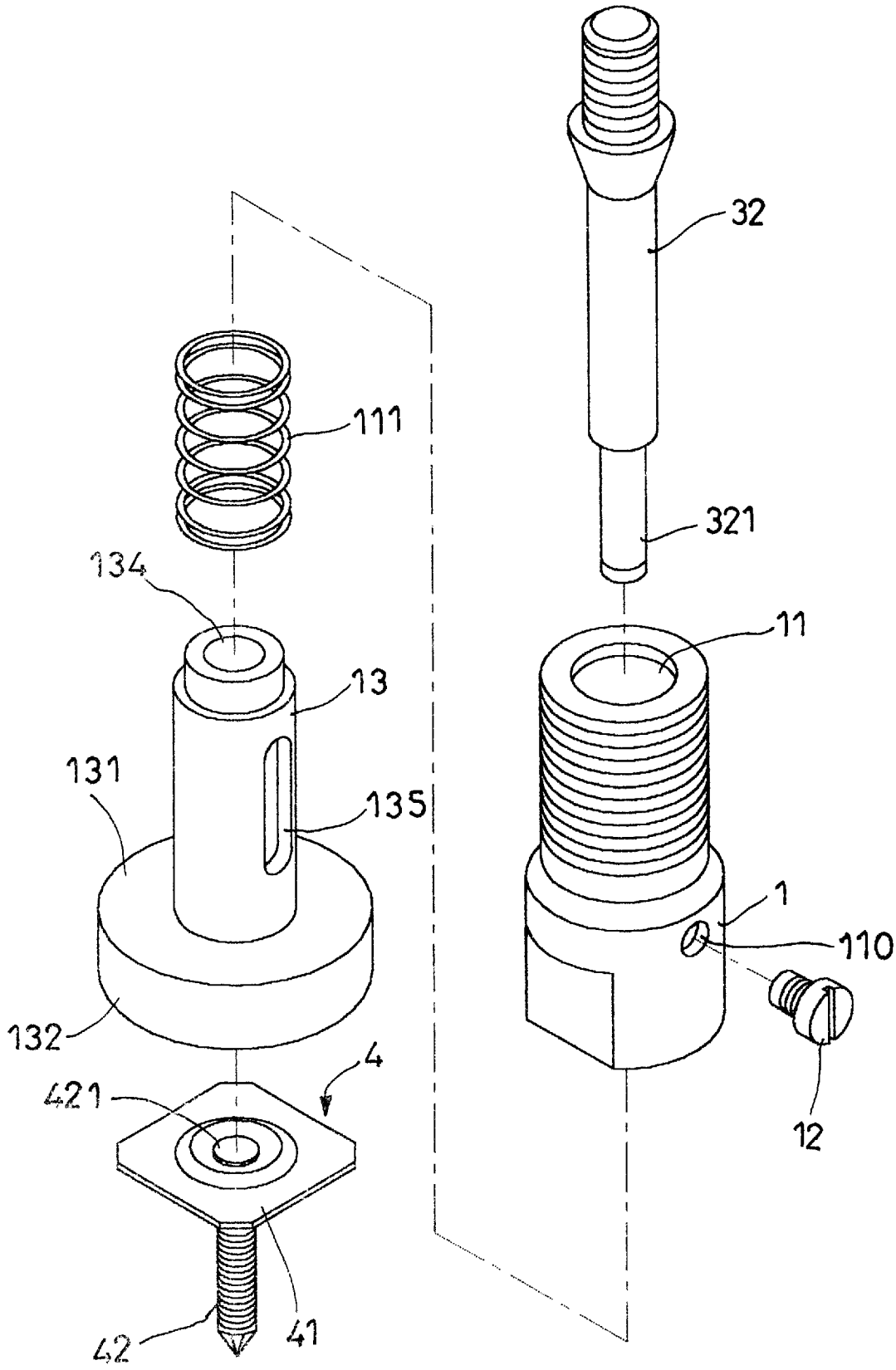
FIG. 1 is an exploded view of a hammer head assembly according to the present invention.
Figure 2:
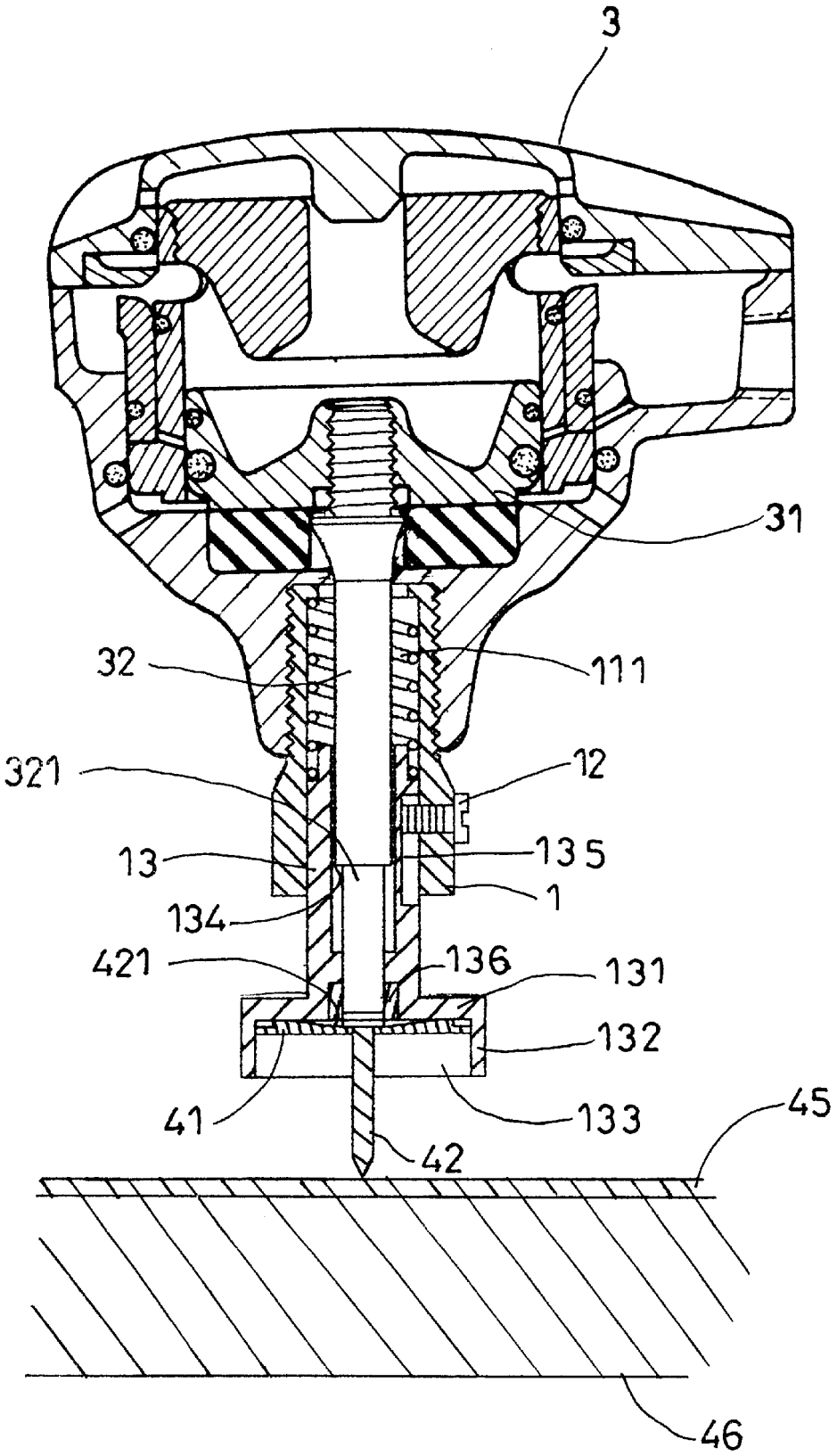
FIG. 2 is an applied view in section of the present invention, showing the hammer head assembly installed in a power hammer.
Figure 3:
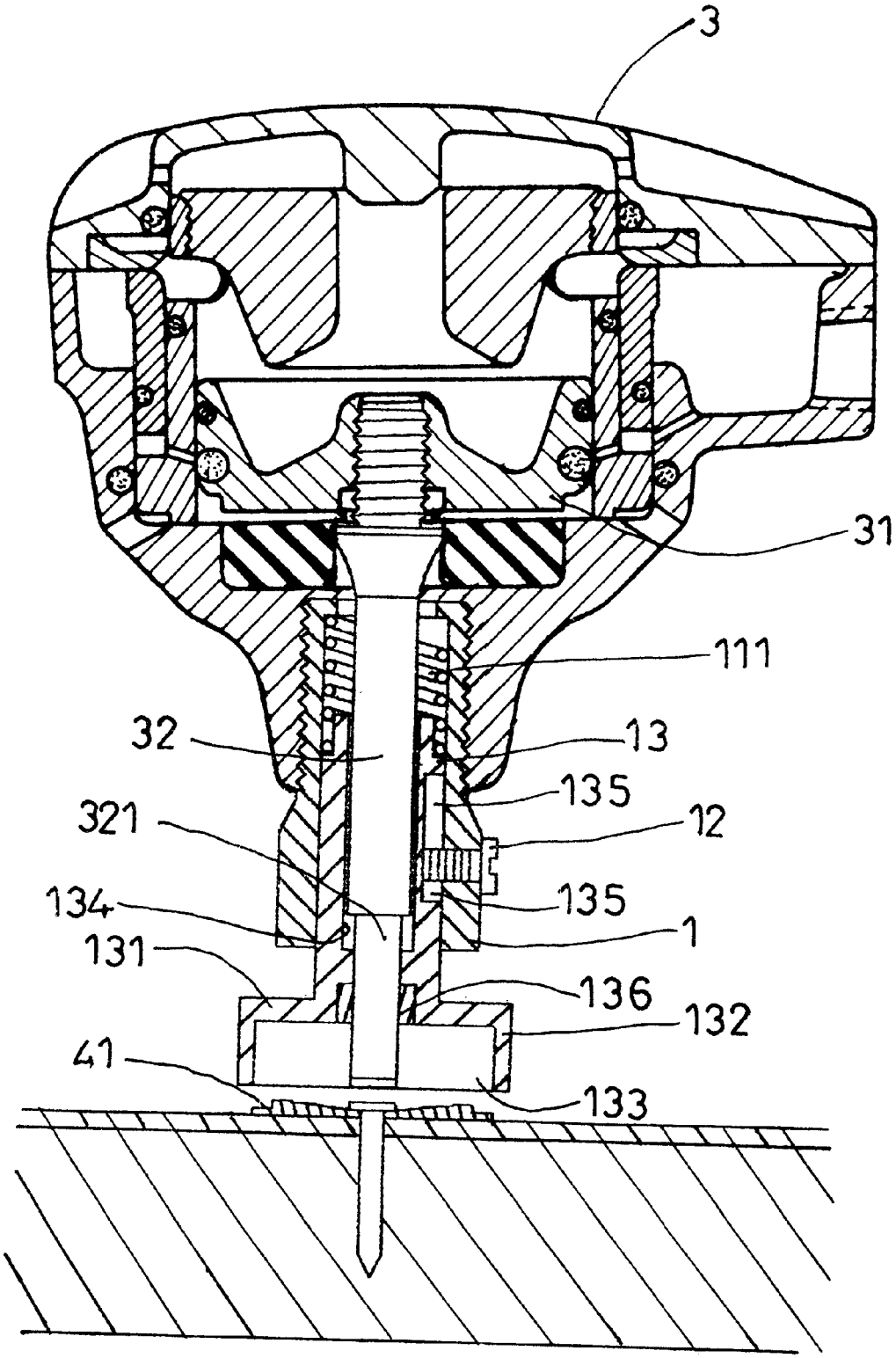
FIG. 3 is similar to FIG. 2 but showing the nail driven into the workpiece.

Referring to FIGS. 1~3, a hammer head assembly is shown used in a power hammer 3, and adapted to drive a washer faced screw nail 4 into a sheet member 45 and a beam (or column) 46 to fix the sheet member 45 to the beam (or column) 46. The hammer head assembly is comprised of an externally threaded mounting base 1, a nail holder 13, a compression spring 111, and a hammering rod 32. The mounting base 1 has an axially extended center through hole 11. The nail holder 13 is inserted into the axially extended center through hole 11 of the mounting base 1, having a longitudinal sliding groove 135 in the periphery, an axially extended center through hole 134, and a bottom skirt 131 extended around the periphery of the bottom end. The bottom skirt 131 has a vertical peripheral wall 132 defining a receiving open chamber 133 adapted to hold the washer 41 of a washer faced screw nail 4. A screw 12 is threaded into a radial screw hole 110 and perpendicularly engaging the longitudinal sliding groove 135 of the nail holder 13 to guide vertical movement of the nail holder 13 in the axially extended center through hole 11 of the mounting base 1 and to stop the nail holder 13 from rotary motion. The compression spring 111 is provided inside the mounting base 1 within the axially extended center through hole 11 and stopped between an upper part of the nail holder 13 and an upper part of the mounting base 1 to push the nail holder 13 downwards relative to the mounting base 1. The hammering rod 32 is inserted through the axially extended center through hole 134 of the nail holder 13, having a stepped tip 321. The top end of the hammering rod 32 is connected to the piston 31 of the power hammer 3. When the power hammer 3 started, the hammering rod 32 is forced by the piston 31 to drive the washer faced screw nail 4 into the sheet member 45 and the beam (or column) 46. The washer faced screw nail 4 comprises a screw nail 42 having a head 421, a washer 41 fastened to the screw nail 42 and closely attached to the head 421 of the screw nail 42 at a bottom side. The washer 41 has chamfer angle 411 in each of the four corners. The receiving open chamber 133 of the nail holder 13 fits the contour of the washer 41. Further, an annular magnet 136 is provided inside the receiving open chamber 133 of the nail holder 13 around the bottom end of the axially extended center through hole 134 and adapted to attract the head 421 of the washer faced screw nail 4, for enabling the washer faced screw nail 4 to be positively and accurately driven into the sheet member 45 and the beam (or column) 46 by the hammering rod 32 upon reciprocating action of the piston 31 of the power hammer 3.

Figure 4:
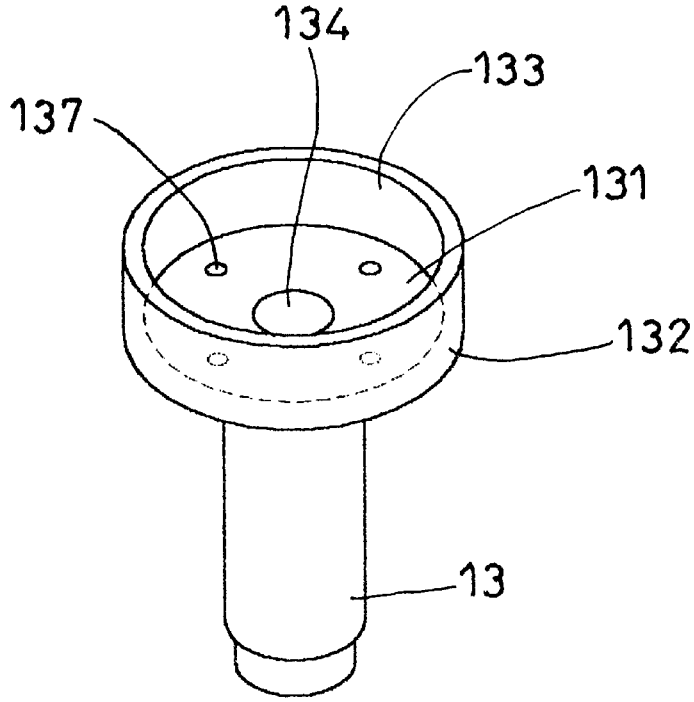
FIG. 4 is a perspective view of an alternate form of the nail holder, showing a plurality of magnetic elements equiangularly spaced from the axially extended center through hole of the nail holder at a distance.
Figure 5:
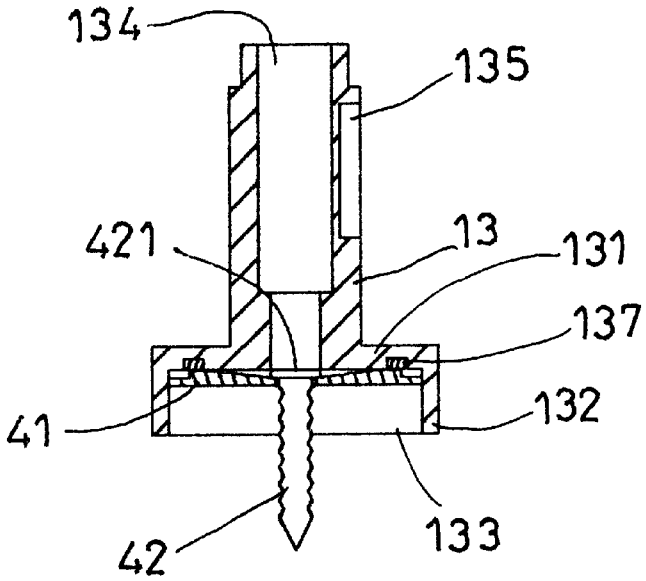
FIG. 5 is a sectional view of a part of the alternate form of the present invention.

Referring to FIGS. 4 and 5, multiple magnetic elements 137 may be provided inside the bottom skirt 131 and equiangularly spaced around the axially extended center through hole 134 at a distance to attract the washer 41 of the washer faced screw nail 4.

Figure 6:
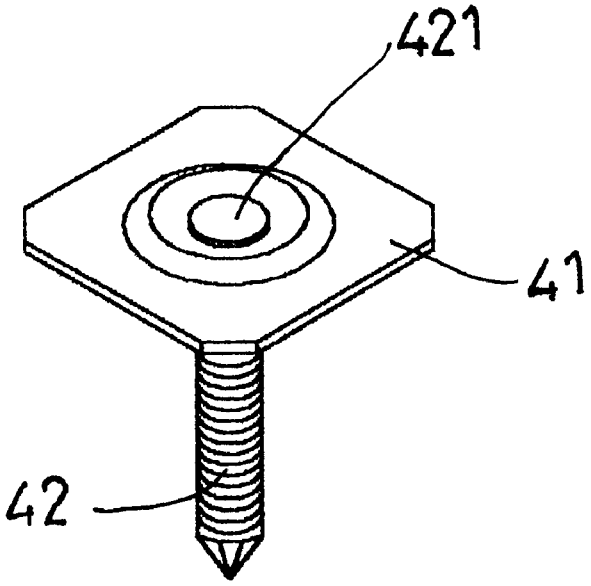
FIG. 6 is a perspective view of a washer faced screw nail with a rectangular washer according to the present invention.
Figure 7:
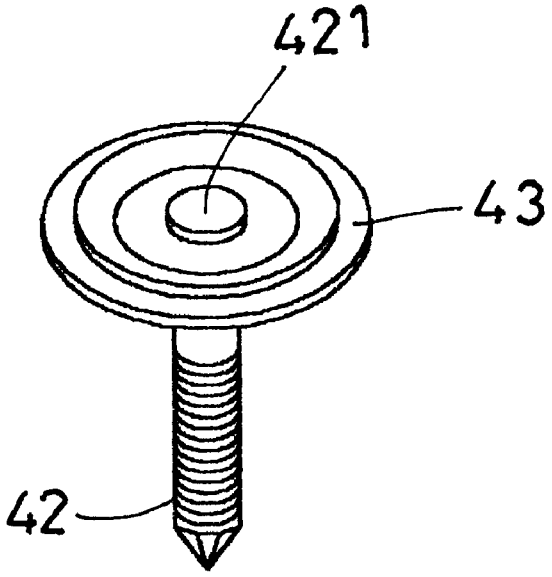
FIG. 7 is a perspective view of a washer faced screw nail with a circular washer according to the present invention.
Figure 8:
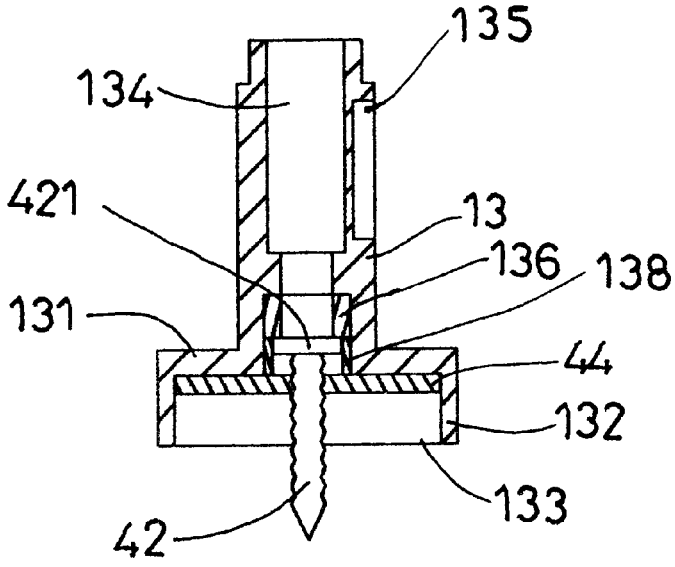
FIG. 8 is a sectional view showing a washer faced screw nail with a plastic washer loaded in the nail holder according to the present invention.

The skirt 131 of the nail holder 13 may be made in any of a variety of shapes to fit different washer faced screw nails. The washer faced screw nail shown in FIG. 6 has a rectangular washer 41 fastened to the screw nail 42 at the bottom side of the head 421 of the screw nail 42. The washer faced screw nail shown in FIG. 7 has a circular washer 43 fastened to the screw nail 42 at the bottom side of the head 421 of the screw nail 42.

FIG, 8 shows an alternate form of the present invention adapted to drive a washer faced screw nail with a plastic washer into the workpiece. As illustrated, the nail holder 13 has a positioning ring 138 provided inside the receiving open chamber 133 at the bottom end of the axially extended center through hole 134. The positioning ring 138 is made of non-magnetic metal. When the plastic washer 44 of the washer faced screw nail loaded in the receiving open chamber 133, the head 421 of the screw nail 42 is inserted into the positioning ring 138 and attracted by the magnet 136 in the axially extended center through hole 134 around the tip 321 of the hammering rod 32.

Figure 10:
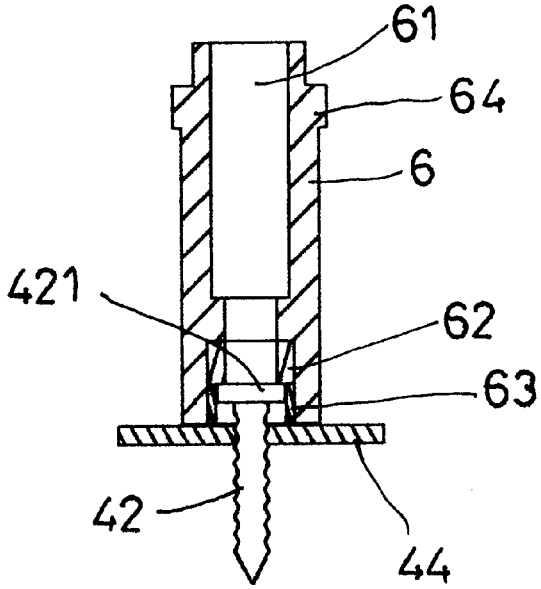
FIG. 10 is a sectional view showing an application example of the hammer head assembly shown in FIG. 9.
Figure 9:
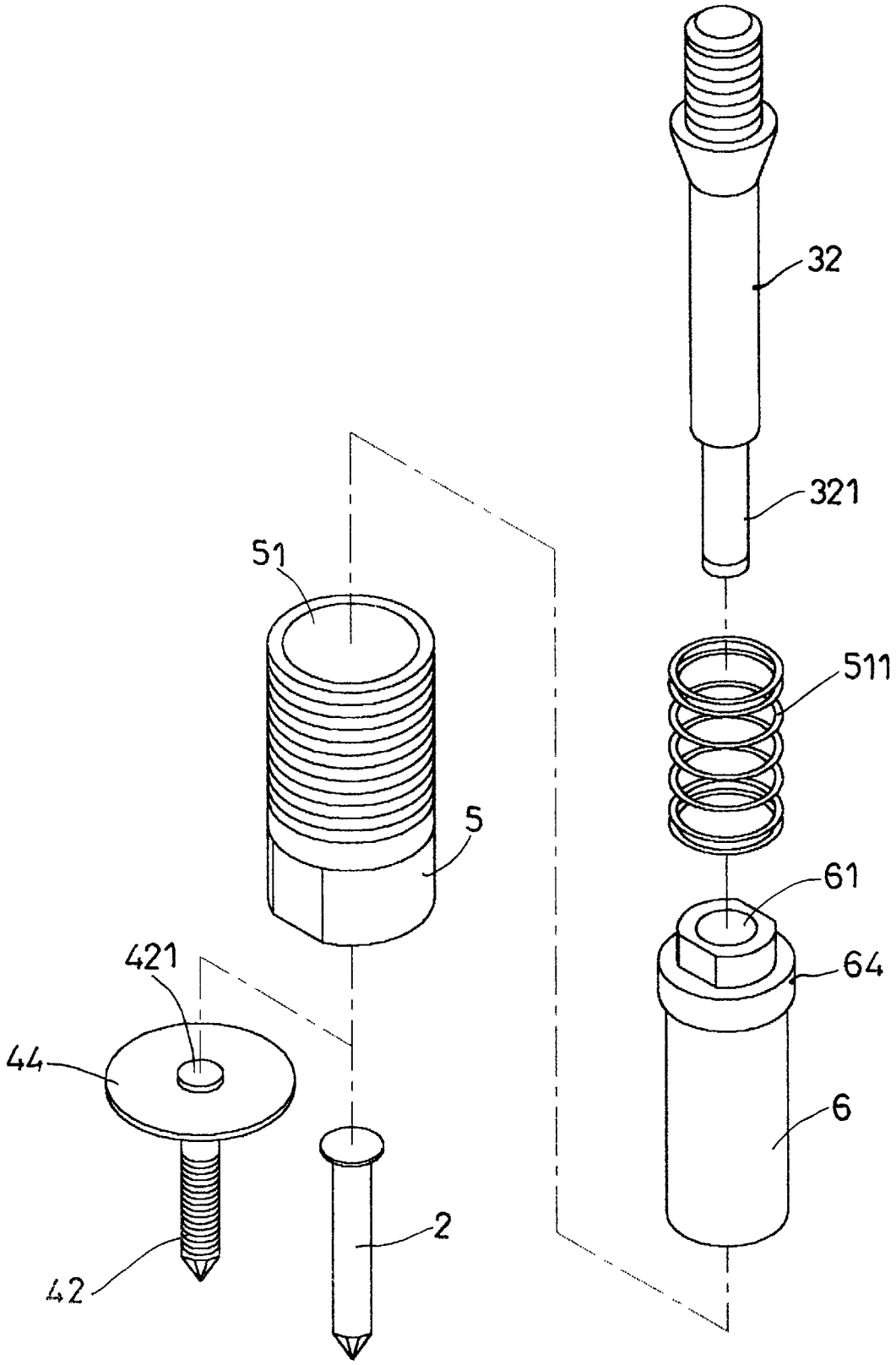
FIG. 9 is an exploded view of an alternate form of the hammer head assembly according to the present invention.
Figure 11:
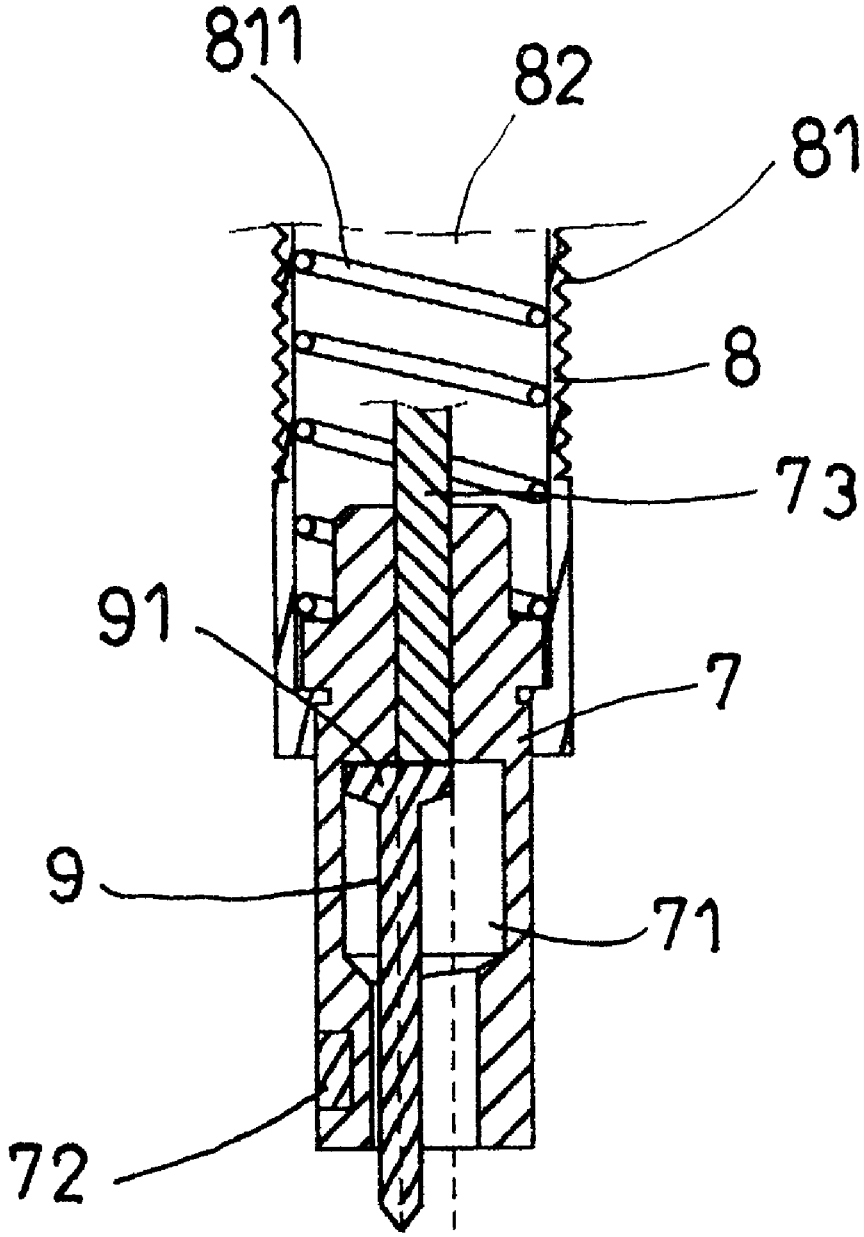
FIG. 11 is a sectional view of the prior art design.

FIGS. 9 and 10 show another alternate form of the present invention practical for driving a screw nail with a plastic washer 44 as well as a regular nail 2 According to this embodiment, the hammer head assembly is comprised of an externally threaded mounting base 5 having an axially extended center through hole 51, a top-flanged nail holder 6 axially movably mounted in the axially extended center through hole 51 of the mounting base 5 and partially extended out of the bottom side of the mounting base 5, a compression spring 511 mounted within the mounting base 5 and imparting a downward pressure to the nail holder 6, and a hammering rod 32 inserted into the axially extended center through hole 61 of the nail holder 6 and controlled to drive the nail into the workpiece. The hammering rod 42 has a stepped tip 321. The nail holder 6 has a positioning ring 63 made of non-magnetic metal and fixedly provided within the bottom end of the axially extended center through hole 61, and an annular magnet 62 fixedly provided inside the axially extended center through hole 61 above the positioning ring 63. The inner diameter of the positioning ring 63 is greater than the inner diameter of the magnet 62. When the head 421 of the screw nail 42 (or the nail 2) inserted into the positioning ring 63, the magnet 62 attracts the screw nail 42 (or the nail 2), enabling the screw nail 42 (or the nail 2) to be accurately driven into the workpiece.

A prototype of hammer head assembly for power hammer has been constructed with the features of FIGS. 1~10. The hammer head assembly for power hammer functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hammer head assembly used in a power hammer for driving a nail into objects to be fastened, comprising:

an externally threaded mounting base fastened to a mounting hole of said power hammer, said mounting base having an axially extended center through hole extended through top and bottom sides thereof;

a nail holder axially slidably inserted into the axially extended center through hole of said mounting base from the bottom side of said mounting base, said nail holder having a longitudinal sliding groove in the periphery thereof, an axially extended center through hole, and a bottom skirt extended around a bottom end of the axially extended center through hole of said nail holder, said bottom skirt having a vertical peripheral wall defining a receiving open chamber adapted to hold the washer of a washer faced screw nail;

a spring member provided inside said mounting base and adapted to force said nail holder downwardly out of said mounting base;

a hammering rod inserted into the axially extended center through hole of said mounting base and the axially extended center through hole of said nail holder and adapted to drive a nail into the workpiece; and at least one magnet mounted inside said nail holder and adapted to attract a nail for enabling the attracted nail to be driven into the workpiece by said hammering rod.

2. The hammer head assembly as claimed in claim 1, wherein said at least one magnet includes a plurality of magnetic elements fixedly mounted inside said bottom skirt and equiangularly spaced from the axially extended center through hole of said nail holder at a distance.

3. The hammer head assembly as claimed in claim 1, wherein said at least one magnet includes an annular magnet provided inside said receiving open chamber of said nail holder around one end of the axially extended center through hole of said nail holder.

4. The hammer head assembly as claimed in claim 1, wherein said nail holder has a longitudinal sliding groove in the periphery thereof; said mounting base comprises a radial screw hole, and a screw threaded into said radial screw hole and perpendicularly engaging the longitudinal sliding groove of said nail holder to guide axial movement of said nail holder in the axially extended center through hole of said mounting base and to stop said nail holder from rotary motion.

5. A hammer head assembly used in a power hammer for driving a nail into objects to be fastened, comprising:

an externally threaded mounting base fastened to a mounting hole of said power hammer, said mounting base having an axially extended center through hole extended through top and bottom sides thereof;

a top-flanged nail holder axially slidably inserted into the axially extended center through hole of said mounting base from the top side of said mounting base, said nail holder having an axially extended center through hole;

a spring member provided inside said mounting base and adapted to force said nail holder downwardly out of said mounting base;

a hammering rod inserted into the axially extended center through hole of said mounting base and the axially extended center through hole of said nail holder and adapted to drive a nail into the workpiece;

a non-magnetic annular metal positioning ring fixedly mounted within the axially extended center through hole of said nail holder in flush with the bottom side of said nail holder; and an annular magnet fixedly provided within the axially extended center through hole of said nail holder at a top side of said non-magnetic annular metal and adapted to attract a nail in said non-magnetic annular positioning ring for enabling the attracted nail to be driven into the workpiece by said hammering rod.

* * * * *